US007581993B1

(12) United States Patent
Lai et al.

(10) Patent No.: US 7,581,993 B1
(45) Date of Patent: Sep. 1, 2009

(54) SOCKET CONNECTOR

(75) Inventors: Ming-Chun Lai, Tu-Cheng (TW); Yu Li, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/081,957

(22) Filed: Apr. 24, 2008

(51) Int. Cl.
*H01R 13/502* (2006.01)

(52) U.S. Cl. ..... 439/687

(58) Field of Classification Search ..... 439/687, 439/63, 885, 736, 497, 733; 29/827, 825, 29/841, 843
See application file for complete search history.

(56) References Cited

U.S. PATENT DOCUMENTS 5,060,372 A * 10/1991 Capp et al. ..... 29/883
5,967,841 A * 10/1999 Bianca et al. ..... 439/590
6,788,547 B2 * 9/2004 Moden ..... 361/772
2006/0128172 A1 * 6/2006 Chien et al. ..... 439/63

* cited by examiner

*Primary Examiner*—Edwin A. Leon
(74) *Attorney, Agent, or Firm*—Rosenberg, Klein & Lee

(57) ABSTRACT

The present invention provides a socket connector adapted for a charger capable of charging a bluetooth earphone. The socket connector includes a plurality of terminals and a dielectric body. Each of the terminals has a soldering portion. All the soldering portions are connected with a terminal strip so that all the terminals are integrated. The dielectric body is integrally formed with the integrated terminals that are pre-arranged in a mold by injection molding. The soldering portions and the terminal strip extend out of the dielectric body so that the terminal strip can be removed after the terminals and the dielectric body are fixed together.

11 Claims, 5 Drawing Sheets

SOCKET CONNECTOR

BACKGROUND OF THE INVENTION

1. Field of the Invention

The present invention generally relates to a socket connector, and more particularly to a socket connector adapted for a charger capable of charging a bluetooth earphone.

2. The Related Art

Referring to FIG. 7, a conventional socket connector 100 used in a charger is shown. The socket connector 100 includes an insulating housing 40, an insulating body 50 assembled with the insulating housing 40 and four ferrous terminals 60 mounted in the insulating body 50 respectively. The insulating housing 40 defines four limiting through-holes 41 in one row. The insulating body 50 protrudes upward to form four bumps 51 in a row and every two of the adjacent bumps 51 are spaced in an interval therebetween. Each bump 51 defines a receiving cavity 52. The terminal 60 has a contact portion 61, a soldering portion 63 and a connecting portion 62 connecting the contact portion 61 and the soldering portion 63. The connecting portion 62 is perpendicular to the contact portion 61 and the soldering portion 63. The contact portion 61 and the soldering portion 63 are parallel with each other and extend toward the same direction.

When the socket connector 100 is assembled, the terminals 60 are placed in a mold one by one, and then the terminals 60 are integrally formed with the insulating body 50 by a method of injection molding. The contact portion 61 of the terminal 60 is received in the receiving cavity 52 of the insulating body 50 for coupling with a mating connector. The connecting portion 62 is inserted in the insulating body 50 and the soldering portion 63 is exposed from the bottom of the insulating body 50 for being soldered on a printed circuit board of the charger. After the insulating body 50 and the terminals 60 are assembled together, the combination of the insulating body 50 and the terminals 60 is assembled with the insulating housing 40. The bumps 51 of the insulating body 50 are respectively inserted into the through-holes 41 defined on the insulating housing 40.

However, because the terminals 60 need being placed in the mold one by one for being integrally formed with the insulating body 50, which wastes time and cannot ensure every two of the adjacent terminals 60 have the predetermined interval therebetween in the insulating body 50, then an improved socket connector is desired.

SUMMARY OF THE INVENTION

Accordingly, an object of the present invention is to provide a socket connector adapted for a charger capable of charging a bluetooth earphone. The socket connector includes a plurality of terminals and a dielectric body. Each of the terminals has a soldering portion. All the soldering portions are connected with a terminal strip so that all the terminals are integrated. The dielectric body is integrally formed with the integrated terminals that are prearranged in a mold by injection molding. The soldering portions and the terminal strip extend out of the dielectric body so that the terminal strip can be removed after the terminals and the dielectric body are fixed together.

As described above, because of the terminal strip connecting to all the soldering portions of the terminals, the terminals are formed integrally. The terminal strip is removed from the terminals after the integrated terminals are placed in the mold and integrally formed with the dielectric body, which saves work time and ensures that the every two of the adjacent terminals have the predetermined interval therebeteween in the dielectric body in order to facilitate the terminals integrally formed with the dielectric body.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
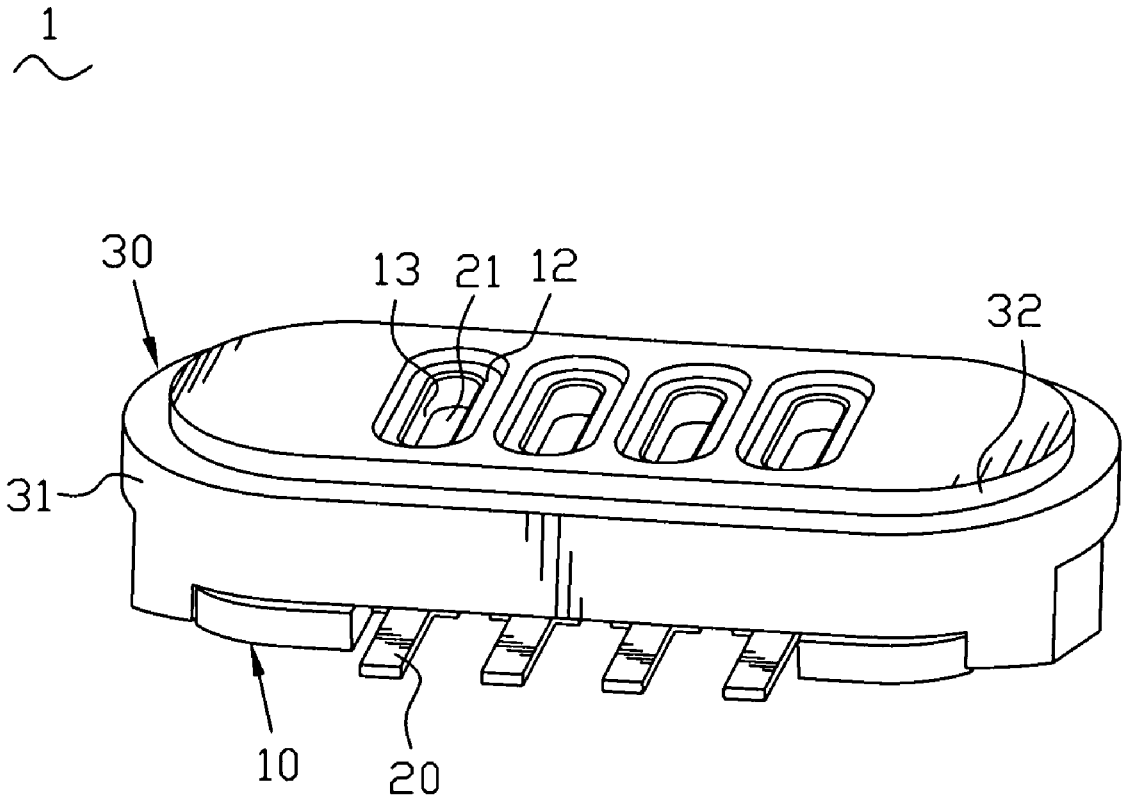
FIG. 1 is a perspective view of a socket connector of the present invention.
Figure 2:
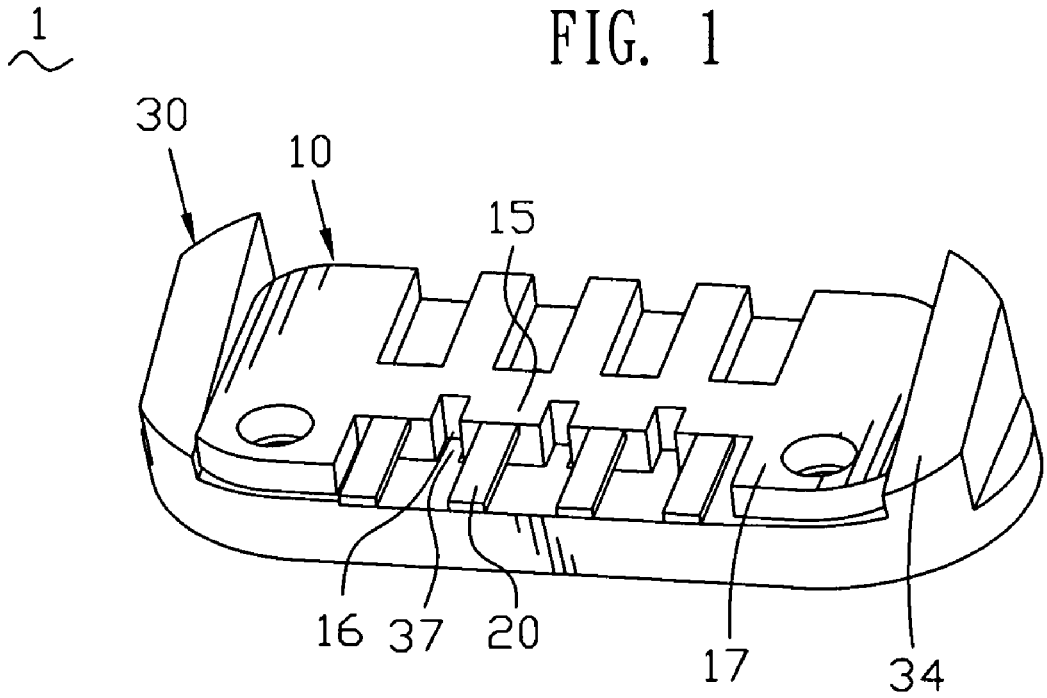
FIG. 2 is another perspective view of the socket connector.

Referring to FIG. 1 and FIG. 2, a socket connector 1 adapted for a charger capable of charging a bluetooth earphone is illustrated that includes a dielectric housing 30, a dielectric body 10 assembled with the dielectric housing 30 and four terminals 20 disposed in the dielectric body 10.

Figure 3:
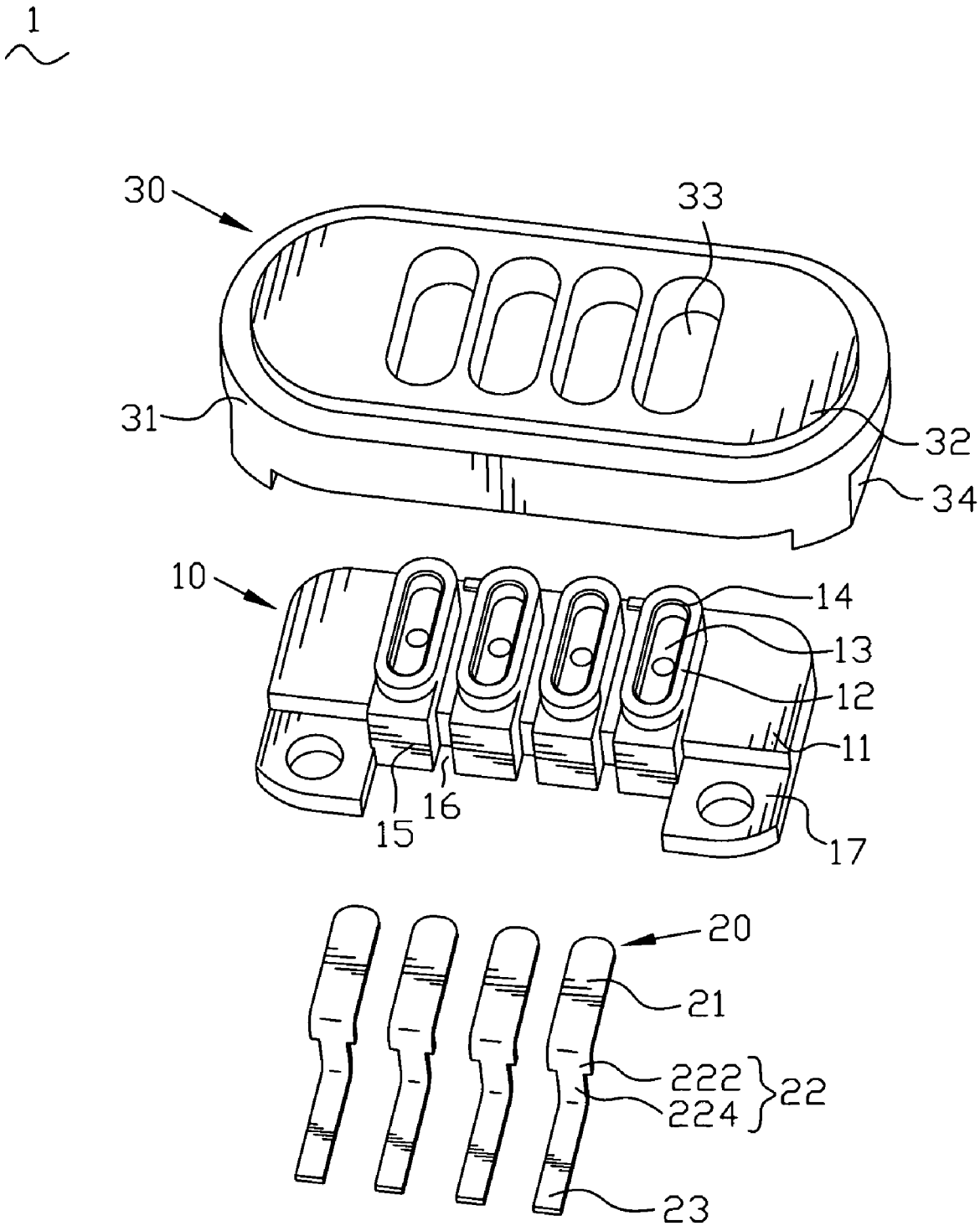
FIG. 3 is an exploded view of the socket connector.
Figure 4:
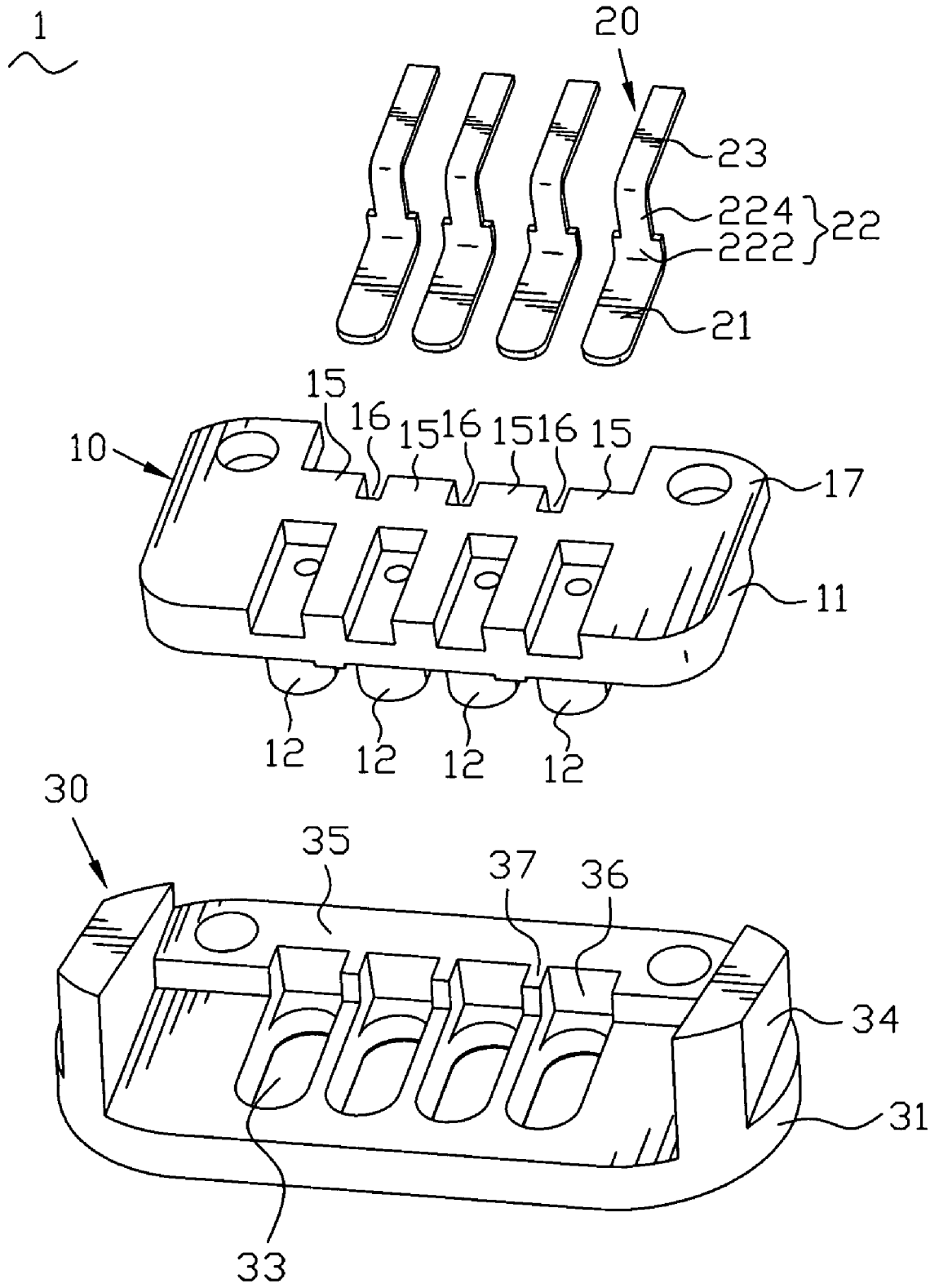
FIG. 4 is another exploded view of the socket connector.

With reference to FIG. 3 and FIG. 4, the dielectric housing 30 has an oval-shaped basic portion 31 disposed transversely. The center of the top of the basic portion 31 transversely protrudes upward to form an oval-shaped projecting portion 32. Four oval-shaped through-holes 33 are longitudinally defined at the center of the top of the projecting portion 32 in a row. Every two of the adjacent through-holes 33 are spaced in an interval therebetween. The bottom of the basic portion 31 protrudes downward to form an extending portion 35 adjacent to the front of the basic portion 31. Four receiving grooves 36 are defined at the bottom of the basic portion 31. The rear of the receiving groove 36 is arc-shaped and tangent with the through-hole 33 passing through the receiving groove 36. The front of the receiving groove 36 is quadrate and extends frontward and employs the extending portion 35 partially. So a limiting portion 37 is formed between every two of the adjacent receiving grooves 36. Opposite sides of the basic portion 31 extend downward to form two blocking portions 34 that enclose the extending portion 35 and the receiving grooves 36 therebetween.

The dielectric body 10 has a substantially rectangular retaining portion 11 disposed transversely. The center of the top of the retaining portion 11 protrudes upward to form four oval-shaped bumps 12 arranged longitudinally in a row and every two of the adjacent bumps 12 are spaced in an interval. Each of the bumps 12 defines an oval-shaped receiving cavity 13 passing through the top thereof. The inner side of the receiving cavity 13 protrudes inward to form a shoulder 14 for a mating connector (not shown) being inserted therein easily. The front of the retaining portion 11 extends frontward to form four quadrate locking portions 15 corresponding to the four receiving cavities 13. Every two of the adjacent locking portions 15 are spaced apart from each other by a locating recess 16 having the same width as the interval defined by the every two of the adjacent bumps 12. The front of the retaining portion 11 extends frontward to define two opposite fixing portions 17 at opposite sides thereof.

Figure 5:
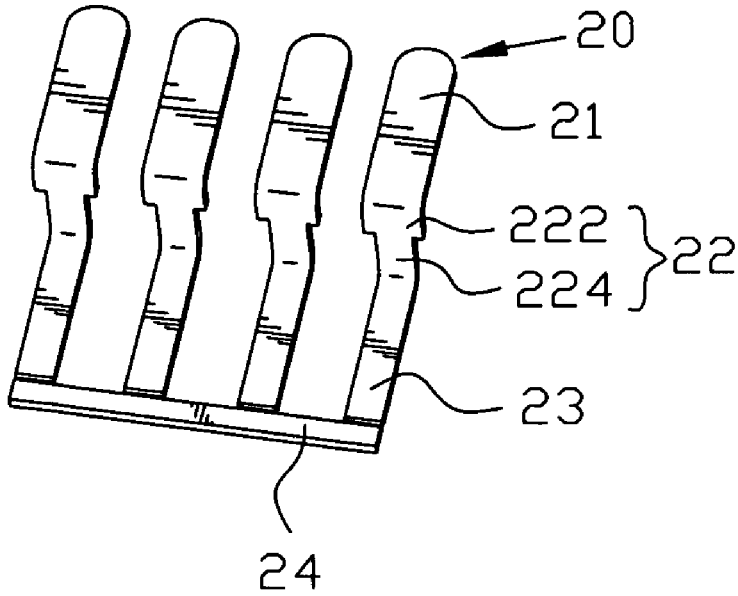
FIG. 5 is a perspective view of terminals connecting with a terminal strip.

Referring to FIG. 3 as well as FIG. 5, the four terminals 20 are formed in a row by punching a board-shaped ferrous material. Every two of the adjacent terminals 20 are spaced in an interval. In the process of forming the terminals 20, the four terminals 20 are integrally formed with a terminal strip 24 in order to facilitate assembly. Each of the terminals 20 has a contact portion 21 in flat strip-shape and disposed horizontally, a soldering portion 23 in flat strip-shape and a connecting portion 22 connecting the contact portion 21 and the soldering portion 23. The rear of the contact portion 21 is arc-shaped. The front of the contact portion 21 extends frontward and extends vertically downward to form a wide portion 222 of the connecting portion 22. The center of the wide portion 222 extends downward continually to form a narrow portion 224 of the connecting portion 22. The narrow portion 224 extends frontward to form the soldering portion 23 perpendicular to the narrow portion 224. The terminal strip 24 connects with the front of the soldering portions 23 of the terminals 20.

Figure 6:
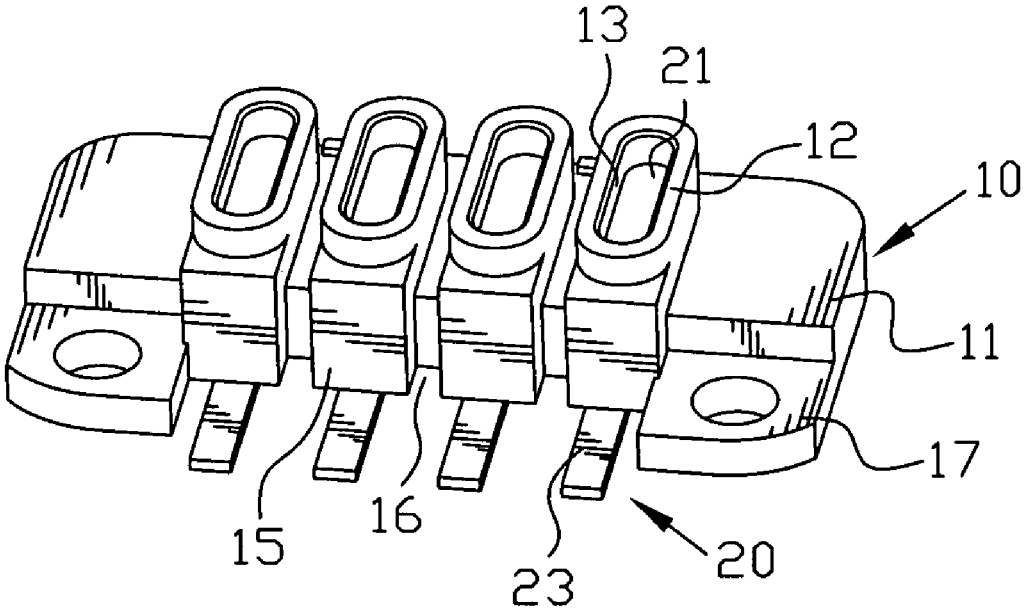
FIG. 6 is a perspective view of the terminals assembled with a dielectric body of the socket connector.
Figure 7:
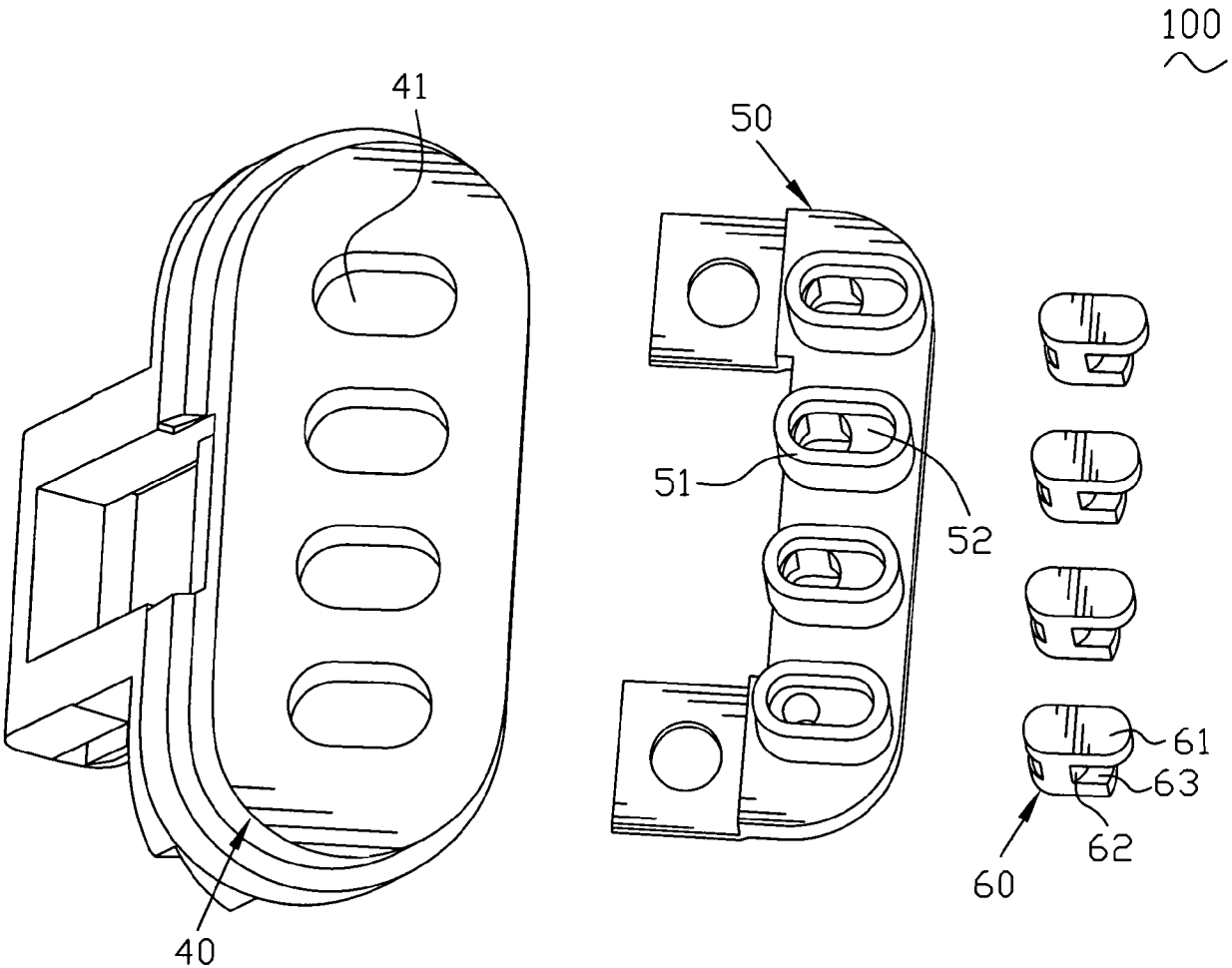
FIG. 7 (Prior Art)
FIG. 7 is an exploded view of a prior socket connector.

Please refer to FIG. 1, FIG. 2 and FIG. 6. In assembly, firstly the four terminals 20 integrally formed with the terminal strip 24 are placed in a mold at the same time, and then the terminals 20 are integrally formed with the dielectric body 10 by a method of injection molding. The contact portion 21 of the terminal 20 is received in the receiving cavity 13 of the dielectric body 10 and fixed on the bottom of the receiving cavity 13. The connecting portion 22 is embedded in the retaining portion 11. The soldering portion 23 is inserted in a lower portion of the locking portion 15 and slantwise extends downward to the front of the locking portion 15 from the center of the locking portion 15. Then after the terminals 20 and the dielectric body 10 are assembled together, the terminal strip 24 is cut apart from the terminals 20. The combination of the terminals 20 and the dielectric body 10 is assembled with the dielectric housing 30. The bumps 12 of the dielectric body 10 are respectively received in the through-holes 33 of the dielectric housing 30. The locking portions 15 are respectively positioned in the front of the receiving grooves 36 and the locating recesses 16 receive the limiting portions 37. The fixing portions 17 are placed on opposite sides of the bottom of the extending portion 35 and blocked by the blocking portions 34 for being fixed in the charger. The soldering portions 23 of the terminals 20 further slantwise extend downward to the front of the dielectric housing 30 for electrically contacting to a printed circuit board. In use, the mating connector with magnets couples with the socket connector 1 (not shown). Contacts of the mating connector are respectively inserted in the receiving cavities 13 of the dielectric body 10 to contact the contact portions 21 of the terminals 20. The mating connector and the socket connector 1 connect with each other stably for the magnetic attraction.

As described above, because of the terminal strip 24 connecting to all the soldering portions 23 of the terminals 20, the terminals 20 are formed integrally. The terminal strip 24 is removed from the terminals 20 after the integrated terminals 20 are placed in the mold and integrally formed with the dielectric body 10, which saves work time and ensures that the every two of the adjacent terminals 20 have the predetermined interval therebetween in the dielectric body 10 in order to facilitate the terminals 20 integrally formed with the dielectric body 10.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A socket connector, comprising:

a plurality of terminals each having a soldering portion, a contact portion and a connecting portion connecting the contact portion and the soldering portion, all the soldering portions being connected with a terminal strip so that all the terminals are integrated, the connecting portion including a wide portion bending downwards from one end of the contact portion, and a narrow portion shrinking inwards and extending downwards from the wide portion to connect the soldering portion; and a dielectric body integrally formed with the integrated terminals that are prearranged in a mold by injection molding, the soldering portions and the terminal strip extending out of the dielectric body so that the terminal strip can be removed after the terminals and the dielectric body are fixed together, the dielectric body having a plurality of receiving cavities formed therein and the contact portion of each of the terminals being respectively received in a corresponding one of the receiving cavities.

2. The socket connector as claimed in claim 1, wherein the terminals are formed in a row by punching a board-shaped conductive material, the contact portions and the soldering portions of the terminals are of flat strip-shape.

3. The socket connector as claimed in claim 1, wherein the terminals are made of iron or iron alloy sheet.

4. A socket connector, comprising:

a plurality of terminals each having a soldering portion and a contact portion, all the soldering portions being connected with a terminal strip so that all the terminals are integrated; and a dielectric body integrally formed with the integrated terminals that are prearranged in a mold by injection molding, the soldering portions and the terminal strip extending out of the dielectric body so that the terminal strip can be removed after the terminals and the dielectric body are fixed together, the dielectric body having a plurality of receiving cavities formed therein, and the contact portion of each of the terminals being respectively received in a corresponding one of the receiving cavities, the dielectric body protrudes upward to form bumps, each of the bumps defines a respective one of the receiving cavities passing through a top thereof, the contact portion of each terminal is fixed on a bottom of the respective receiving cavity, a front of the dielectric body extends frontward to form locking portions corresponding to the receiving cavities, the soldering portion of the terminal is inserted in a lower portion of the locking portion and slantwise extends downward from the center of the locking portion to a front thereof.

5. The socket connector as claimed in claim 4, wherein the terminals are formed in a row by punching a board-shaped conductive material, the contact portions and the soldering portions of the terminals are of flat strip-shape.

6. The socket connector as claimed in claim 4, wherein the terminals are made of iron or iron alloy sheet.

7. A socket connector comprising:

a plurality of terminals each having a soldering portion and a contact portion, all the soldering portions being connected with a terminal strip so that all the terminals are integrated; and a dielectric body integrally formed with the integrated terminals that are prearranged in a mold by injection molding, the soldering portions and the terminal strip extending out of the dielectric body so that the terminal strip can be removed after the terminals and the dielectric body are fixed together, the dielectric body having a plurality of receiving cavities formed therein and the contact portion of each of the terminals being respectively received in a corresponding one of the receiving cavities, the dielectric body protrudes upward to form bumps, each of the bumps defines a respective one of the receiving cavities passing through a top thereof, the contact portion of each terminal is fixed on a bottom of the respective receiving cavity, a dielectric housing covering a top of the dielectric body, the dielectric housing defining through-holes, the bumps of the dielectric body being received in the through-holes respectively, the soldering portion of the terminal slantwise extending downward to a front of the dielectric housing.

8. The socket connector as claimed in claim 7, wherein the terminals are formed in a row by punching a board-shaped conductive material, the contact portions and the soldering portions of the terminals are of flat strip-shape.

9. The socket connector as claimed in claim 7, wherein the terminals are made of iron or iron alloy sheet.

10. The socket connector as claimed in claim 7, wherein the dielectric housing has a basic portion, a bottom of the basic portion protrudes downward to form an extending portion, receiving grooves are defined at the bottom of the basic portion and communicate with the through-holes, a front of the receiving groove extends frontward and employs the extending portion partially, so a limiting portion is defined between every two of the adjacent receiving grooves, the front of the dielectric body extends frontward to form locking portions positioned in the receiving grooves, every two of the adjacent locking portions are spaced apart from each other by a locating recess receiving the limiting portion.

11. The socket connector as claimed in claim 10, wherein a rear of the receiving groove is tangent with the through-hole.

* * * * *